US011066940B2

(12) United States Patent
Allouis et al.

(10) Patent No.: US 11,066,940 B2
(45) Date of Patent: Jul. 20, 2021

(54) TURBINE ENGINE ASSEMBLY INCLUDING A TAPPET ON A SEALING RING

(71) Applicant: SAFRAN AIRCRAFT ENGINES, Paris (FR)

(72) Inventors: Christophe Pascal Laurent Jean Robert Allouis, Moissy-Cramayel (FR); Sebastien Georges Roger Goux, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/789,494

(22) Filed: Feb. 13, 2020

(65) Prior Publication Data

US 2020/0263556 A1 Aug. 20, 2020

(30) Foreign Application Priority Data

Feb. 18, 2019 (FR) ..... 19 01616

(51) Int. Cl.
*F01D 5/30* (2006.01)
*F01D 11/00* (2006.01)

(52) U.S. Cl.
CPC ..... *F01D 5/3015* (2013.01); *F01D 11/006* (2013.01); *F05D 2220/323* (2013.01); *F05D 2240/55* (2013.01); *F05D 2240/80* (2013.01); *F05D 2260/30* (2013.01)

(58) Field of Classification Search
None
See application file for complete search history.

(56) References Cited

U.S. PATENT DOCUMENTS 3,266,770 A * 8/1966 Harlow ..... F01D 5/22 416/92
4,033,705 A * 7/1977 Luebering ..... F01D 5/3015 416/220 R
4,247,257 A * 1/1981 Benoist ..... F01D 5/3015 416/220 R
5,169,289 A * 12/1992 Lalanne ..... F01D 5/3015 416/220 R (Continued)

FOREIGN PATENT DOCUMENTS

EP 1 584 794 A1 10/2005
FR 2 729 709 A1 7/1996

(Continued)

OTHER PUBLICATIONS

French Preliminary Search Report dated Oct. 8, 2019 in French Application 19 01616 filed on Feb. 18, 2019 (with English Translation of Categories of Cited Documents), 2 pages.

*Primary Examiner* — Michael Lebentritt
(74) *Attorney, Agent, or Firm* — Oblon, McClelland, Maier & Neustadt, L.L.P.

(57) ABSTRACT

A turbine engine assembly includes a rotor disk extending around an axis A, a sealing flange centered on the axis A, the flange including a radially external portion that can come into contact with a face axially opposite the rotor disk in order to provide the tightness and a radially internal portion including a groove open axially towards the rotor disk and including a ring which is received in the groove of the flange and which is received in the groove of the flange. The ring includes at least one protruding tappet that is received in a notch formed in the flange.

10 Claims, 2 Drawing Sheets

(56) References Cited

U.S. PATENT DOCUMENTS 5,350,279 A * 9/1994 Prentice ..... F01D 5/323 416/220 R
5,472,313 A * 12/1995 Quinones ..... F01D 5/082 415/115
5,553,999 A * 9/1996 Proctor ..... F01D 11/08 415/134
6,457,942 B1 * 10/2002 Forrester ..... F01D 11/008 416/220 R
7,556,474 B2 * 7/2009 Marchi ..... F01D 5/3015 415/115
7,686,585 B2 * 3/2010 Buisson ..... F04D 29/322 416/220 R
8,840,375 B2 * 9/2014 Virkler ..... F01D 5/08 416/221
10,138,741 B2 * 11/2018 Littler ..... F01D 5/3015
2008/0008593 A1 * 1/2008 Zagar ..... F01D 5/3015 416/220 R
2008/0050245 A1 * 2/2008 Cloarec ..... F01D 5/3015 416/97 R
2008/0273982 A1 * 11/2008 Chunduru ..... F01D 5/326 416/220 R
2009/0123273 A1 * 5/2009 Audeon ..... F01D 11/08 415/177
2013/0004319 A1 * 1/2013 Lee ..... F01D 5/3015 416/219 R
2013/0323064 A1 * 12/2013 Boyington ..... F01D 11/008 416/219 R
2015/0071769 A1 * 3/2015 Gieg ..... F01D 25/285 415/173.1
2015/0292342 A1 * 10/2015 Ring ..... F01D 25/246 415/208.2
2015/0361812 A1 * 12/2015 Marino ..... F01D 25/243 415/214.1
2016/0177759 A1 * 6/2016 Tuertscher ..... F01D 9/042 415/200
2016/0177768 A1 * 6/2016 Borja ..... F01D 11/18 415/134
2016/0265378 A1 * 9/2016 Dungs ..... F01D 5/12
2018/0238172 A1 * 8/2018 Capolungo ..... F01D 5/082
2018/0274381 A1 * 9/2018 Dooley ..... F01D 5/30
2018/0363780 A1 * 12/2018 Aksit ..... F16J 15/3292
2019/0085699 A1 * 3/2019 Oudin ..... F01D 11/02
2020/0332670 A1 * 10/2020 Moga ..... F01D 25/246

FOREIGN PATENT DOCUMENTS

FR 3 051 827 A1 12/2017
GB 2 268 979 A 1/1994

* cited by examiner

TURBINE ENGINE ASSEMBLY INCLUDING A TAPPET ON A SEALING RING

TECHNICAL FIELD

The invention relates to a turbine engine assembly including a rotor disk and a plurality of sealing flanges.

It is common to have recourse to sealing flanges in order to prevent air leaks at the roots of blades.

PRIOR ART

Among the known flanges, some are configured to pivot in relation to the rotor disk through centrifugal force between an idle position wherein they bear, by a radially internal edge, on the hub of the disk, and an operating position wherein a radially external portion of these flanges is applied on the disk in order to prevent air leaks.

In order to favor the tightness and allow for the pivoting of the flanges, it is provided that an annular ring be received in a complementary groove formed in each flange.

More precisely, the ring includes a tilted wall that radially bears against a complementary face of the flange and, through centrifugal force, the diameter of the ring increases, causing the pivoting of the flanges.

In order to allow for the increase in the diameter thereof, the ring includes a cut-out, in such a way that the ring forms a split ring.

As the operating cycles of the turbine engine take place, i.e. as the different dilatations of the ring take place, the edges of the cut-out rub against a wall opposite the rotor disk, causing a localized wear on the rotor disk.

This wear is particularly a problem when it is located at cells of the rotor disk because this zone is substantially loaded mechanically. Thus, the wear of the rotor disk at the cells weakens the rotor disk.

The invention has for purpose to propose a rotor disk assembly including such sealing flanges that make it possible to certainly position and maintain the sealing ring in such a way as to guarantee the tightness of the assembly during operation.

DISCLOSURE OF THE INVENTION

The invention proposes a turbine engine assembly including a rotor disk extending around an axis A, a sealing flange centered on the axis A, the flange including a radially external portion that can come into contact with a face axially opposite the rotor disk in order to provide the tightness and a radially internal portion including a groove axially open towards the rotor disk and including a ring that is received in the groove of the flange and which is received in said groove of the flange, characterized in that the ring includes at least one protruding tappet that is received in a notch formed in the flange.

Preferably, the tappet protrudes axially and/or radially with respect to the ring.

Preferably, the rotor disk includes, at the periphery thereof, an alternation of teeth and of cells oriented mainly axially, the ring is a ring split by a cut-out, and the cut-out is located in line with a tooth of the rotor disk.

Preferably, the tappet of the ring is disposed diametrically opposite the cut-out of the ring.

Preferably, said at least one tappet is located in line with a tooth of the rotor disk.

Preferably, the assembly includes a plurality of flanges distributed circumferentially around the axis A, and the ring includes several tappets, each tappet being received in a groove formed in a respective flange.

Preferably, the assembly includes a plurality of flanges distributed circumferentially around the axis A, and the ring includes, a single tappet received in a complementary groove formed in one of the flanges.

Preferably, the notch is formed by the circumferential ends contiguous to two circumferentially adjacent flanges.

The invention also proposes a turbine engine, in particular an aircraft turbine engine comprising an assembly according to the invention.

BRIEF DESCRIPTION OF THE DRAWINGS

Other characteristics and advantages of the invention shall appear when reading the detailed description that follows for the understanding of which reference will be made to the accompanying figures among which.

DETAILED DESCRIPTION

Figure 1:
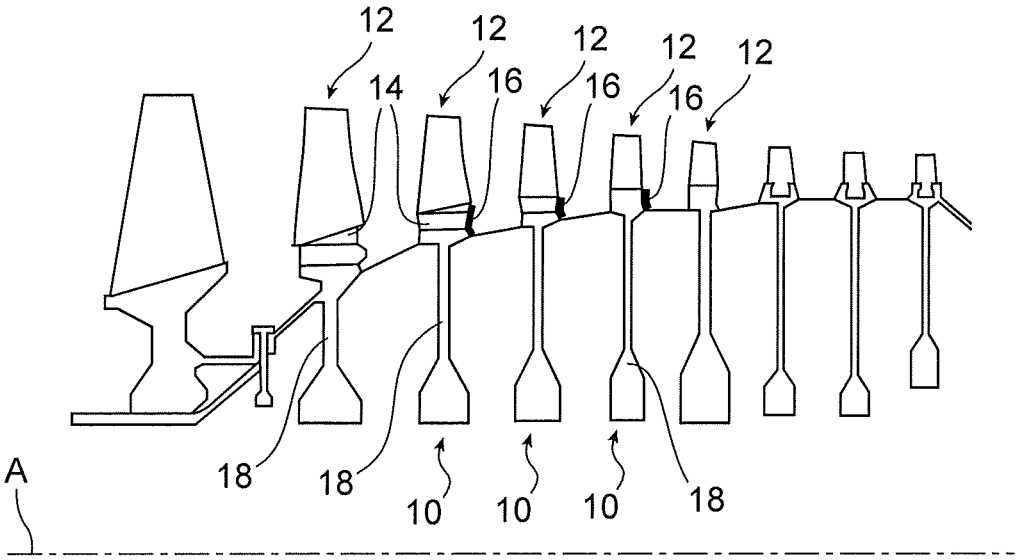
FIG. 1 partially diagrammatically shows in perspective a sealing flange according to prior art mounted on a rotor disk.

FIG. 1 shows a portion of the rotor of a high-pressure compressor of a turbine engine that comprises several rotor disks 10, each disk 10 carrying a plurality of substantially radial blades 12 of which the roots 14 are engaged in mainly axial grooves 44, for example in dovetail fashion, of the periphery of the disk.

Several sealing flange 16 are mounted on the downstream face of the disk 10, at the blade roots and in radial proximity of an outer surface of the hub 18 of the disk 10. Each flange 16 forms a sector of a ring centered on the main axis A of the rotor disk 10. The flanges 16 are circumferentially distributed around the main axis A and they are contiguous to one another to form together a ring.

Figure 2:
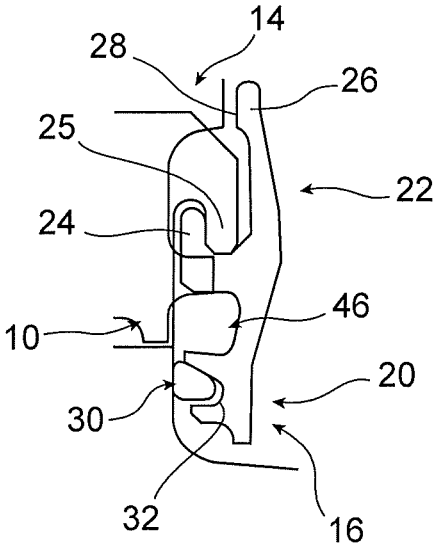
FIG. 2 partially diagrammatically shows in perspective a sector of a sealing flange according to the invention.
Figure 3:
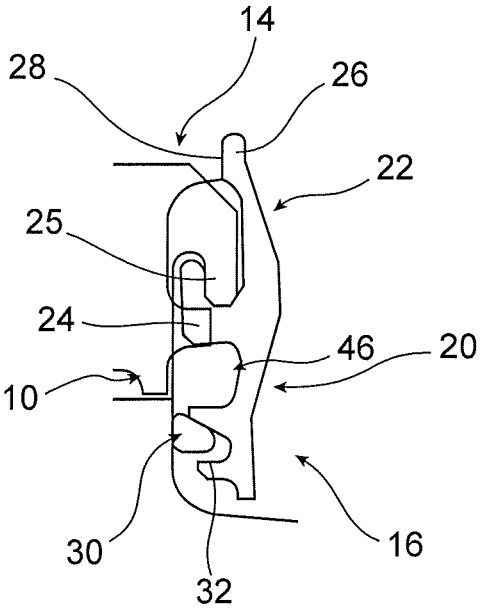
FIG. 3.

As can be seen in more detail in FIGS. 2 and 3, each flange 16 comprises, from a general point of view, a radially internal portion 20 and a radially external portion 22.

The radially external portion 22 comprises a peripheral lip 26, that has an axial bearing surface 28 formed on the upstream face of the flange 16 and intended to be applied on the blade roots 14 when the turbine engine is operating, as can be seen in FIG. 3.

Each flange 16 further includes an upstream portion 24 that cooperates with an associated portion 25 of the disk 10 in order to form a tipping point of the flange 16 around a transversal axis, i.e. tangential with respect to the main axis of the compressor.

The upstream face of the radially internal portion 20 of the flange 16 further includes a groove 32 that is axially open towards the upstream and wherein an annular sealing ring 30 is mounted.

The annular sealing ring 30 is also in contact on the downstream face of the disk 10.

The groove 32 and the ring 30 include opposite contact surfaces and which are tilted with respect to the main axis of the disk 10.

Figure 4:
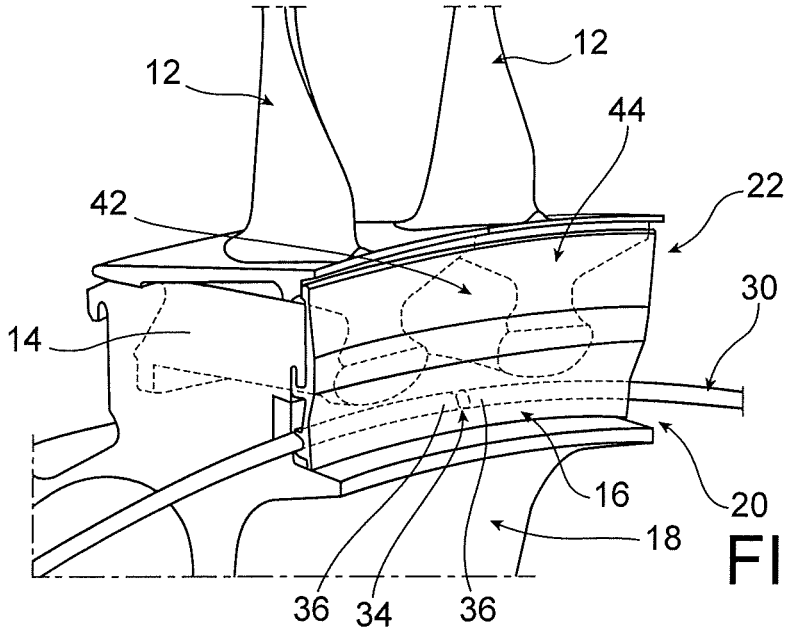
FIG. 4 partially diagrammatically show in perspective a rotor disk whereon is mounted the flask sector of FIG. 2.

As can be seen in FIG. 4, the ring 30 includes a cut-out 34 which gives the ring 30 a split ring shape.

The cut-out 34 allows in particular the ring 30 to be deformed in order to facilitate mounting it in the groove 32 of each one of the flanges 16.

Therefore, thanks to the presence of the cut-out 34, the two ends 36 of the ring 30, which are separated by the cut-out 34, are able to come closer or to move apart from one another according to the operating conditions of the turbine engine.

As shown in FIG. 3, during the rotation of the rotor, the centrifugal force causes an increase in the diameter of the ring 30, i.e. a separating of the circumferential ends 36 thereof.

Through this increase in diameter of the ring 30 the faces opposite the groove 32 and the ring 30 cooperate to cause a tipping of the flange 16 and thus obtain the bearing of the bearing surface 28 of the peripheral lip 26 of the flange 16 against the downstream portion of the roots 14 of the blades 12.

Moreover, during this increase in diameter, the ring 30 is engaged in the groove 32 of the flange 16 and it is applied on the side of the disk 10. The tightness is thus provided both by the ring 30 and by the peripheral lip 26.

When the rotor is stopped, as shown in FIG. 2, the flange 16 is no longer subjected to a centrifugal thrust and the radially internal portion 20 of the flange 16 rests axially on the surface of the hub 18 that it is facing.

The ring 30 also includes a tappet 38 that protrudes with respect to the ring 30.

Figure 5:
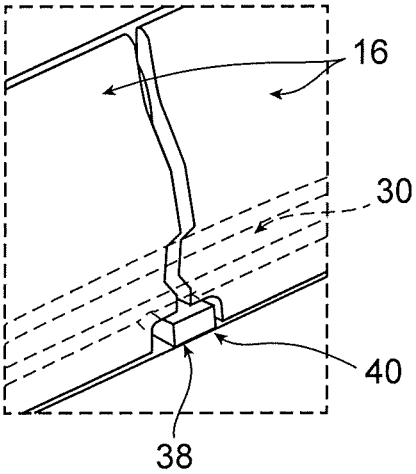
FIG. 5 is a detail showing a tappet received in a notch formed in two flanges.
Figure 6:
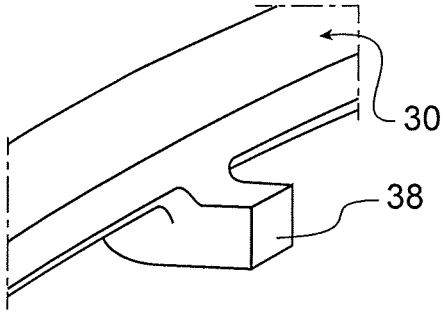
FIG. 6 is a detail of the ring showing the tappet that it carries.

According to the embodiment shown in FIGS. 5 and 6, the tappet 38 protrudes radially outwards and axially downstream with respect to the rest of the ring 30. It will be understood that the invention is not limited to this embodiment and that the ring can protrude solely according to the axial direction, for example.

This tappet 38 is received in a notch 40 of complementary shape and which is made in at least one flange 16.

According to a first embodiment of the notch 40, the latter is formed in a single flange 16.

According to a second embodiment, the notch 40 is formed by the circumferential ends of two circumferentially adjacent flanges 16 which are contiguous to one another.

The cooperation of the tappet 38 and of the notch 40 that it is associated with makes it possible to prevent any rotation of the ring 30 around the main axis of the disk 10.

Thus, the cut-out 34 formed in the ring 30 is always at a predefined angular position in relation to the disk 10.

As can be seen in more detail in FIG. 4, the tappet 38 and the notch 40 are shaped so that the cut-out 34 is located in line with a tooth 42 of the disk 10 and more precisely, radially under a tooth 42 of the disk 10. Each tooth 42 of the disk 10 is delimited by two cells 44 that are disposed circumferentially on either side of the tooth 42. Each cell 44 being a mainly axial groove that is shaped to receive the root 14 of a blade 12.

Thus, as the variations in diameter of the ring 30 take place, the friction of the ends 36 of the ring 30 causes a wear of the disk 10 at this tooth.

This location of the wear at the tooth 42 is preferred to a wear at the cell 44 because the concentration of stresses at the tooth 42 is less.

According to a preferred embodiment, the tappet 38 is diametrically opposite in relation to the cut-out 34. This makes it possible in particular to have a ring 30 with a symmetrical structure.

Therefore, preferably, the tappet 38 protrudes radially inwards and axially downstream with respect to the rest of the ring 30, as shown in FIGS. 4 to 7.

According to an alternative embodiment, the ring 30 includes several tappets 38, of which each one is received in a complementary notch 40 that is associated with it.

According to a first embodiment of the notch 40, it is made in a single flange 16.

Figure 7:
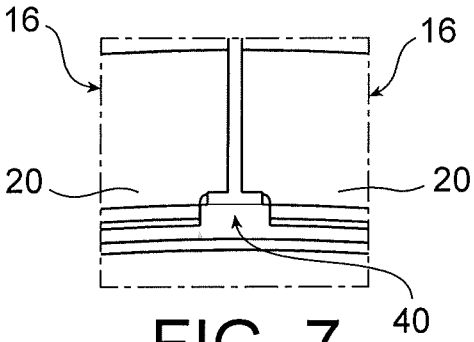
FIG. 7 is a detail of two flanges shown in FIG. 5, showing the notch formed in these two flanges.

According to an alternative embodiment shown in FIG. 7, the notch formed at circumferentially opposite edges of two adjacent flanges.

In addition to the angular positioning of the cut-out 34 of the ring 30, the presence of at least one tappet 38 on the ring 30 also makes it possible to prevent mounting the ring 30 in a secondary groove 46 of the flange 16, which is radially offset outwards with respect to the groove 32 intended to receive the ring 30. Here, the secondary groove 46 is located between the groove 32 and the upstream portion 24 of the flange 16.

Indeed, mounting the ring 30 in the secondary groove 46 prevents the ring 30 from being able to cause the tipping of the flange 16 and favor good tightness by being applied against the side of the disk 10.

Therefore, mounting the ring 30 in the secondary groove 46 instead mounting it in the groove 32 would prevent mounting all the other flanges 16 because it would mechanically interfere with the latter or certain flanges only.

Therefore, the cooperation of each tappet 38 with the associated notch 40 makes it possible to block the ring 30 in rotation around the main axis of the rotor disk 10. Consequently, the cut-out 34 is positioned at a tooth 42, as described hereinabove, and it is also maintained in this position by the tappet and the notch 40.

The invention claimed is:

1. A turbine engine assembly comprising:

a rotor disk extending around an axis A, and a sealing flange centered on the axis A, the flange including a radially external portion that can come into contact with a face axially opposite the rotor disk in order to provide the tightness and a radially internal portion including a groove open axially towards the rotor disk and including a ring which is received in the groove of the flange and which is received in said groove of the flange, wherein the ring includes at least one protruding tappet that is received in a notch formed in the flange.

2. The turbine engine assembly according to claim 1, wherein the tappet protrudes axially and/or radially with respect to the ring.

3. The turbine engine assembly according to claim 2, wherein the rotor disk comprises, at the periphery thereof, an alternation of teeth and of cells oriented mainly axially, wherein the ring is a ring split by a cut-out, and wherein the cut-out is located in line with a tooth of the rotor disk.

4. The turbine engine assembly according to claim 3, wherein the tappet of the ring is disposed diametrically opposite the cut-out of the ring.

5. The turbine engine assembly according to claim 3, wherein said at least one tappet is located in line with a tooth.

6. The turbine engine assembly according to claim 1, further comprising a plurality of flanges distributed circumferentially around the axis A, and wherein the ring includes several tappets, each tappet being received in a groove formed in a respective flange.

7. The turbine engine assembly according to claim 1, further comprising a plurality of flanges distributed circumferentially around the axis A, and wherein the ring includes a single tappet received in a complementary groove formed in one of the flanges.

8. The turbine engine assembly according to claim 6, wherein the notch is formed by the circumferential ends contiguous to two circumferentially adjacent flanges.

9. A turbine engine, comprising the turbine engine assembly according to claim 1.

10. The turbine engine according to claim 9, wherein the turbine engine is an aircraft turbine engine.

* * * * *